US006913717B2

(12) United States Patent
Sayadi et al.

(10) Patent No.: US 6,913,717 B2
(45) Date of Patent: Jul. 5, 2005

(54) METHOD OF CONSTRUCTING A RAIL TRACK IN WHICH A CONCRETE TRACK SLAB IS PRODUCED AND RAIL TRACK ANCHOR MEMBERS ARE INSERTED INTO THE TRACK SLAB

(75) Inventors: Marc Sayadi, Paris (FR); Yvan Skific, Paris (FR)

(73) Assignee: Alstom, Paris (FR)

( * ) Notice: Subject to any disclaimer, the term of this patent is extended or adjusted under 35 U.S.C. 154(b) by 397 days.

(21) Appl. No.: 10/309,075

(22) Filed: Dec. 4, 2002

(65) Prior Publication Data

US 2003/0102586 A1 Jun. 5, 2003

(30) Foreign Application Priority Data

Dec. 5, 2001 (FR) ..... 01 15730

(51) Int. Cl.[7] ..... E01B 37/00; E01B 29/32; E01B 9/40

(52) U.S. Cl. ..... 264/33; 264/34; 264/35; 264/40.1; 264/70; 264/228; 264/333; 425/63; 425/64; 425/111; 425/113; 249/86; 238/5; 238/7

(58) Field of Search ..... 264/33, 34, 35, 264/40.1, 70, 228, 333; 425/63, 64, 111, 113; 249/86; 238/5, 7

(56) References Cited

U.S. PATENT DOCUMENTS

| | | | | | |
|---|---|---|---|---|---|
| 1,633,211 | A | * | 6/1927 | Jenks | 238/3 |
| 2,225,015 | A | * | 12/1940 | Lebelle | 404/75 |
| 2,587,321 | A | * | 2/1952 | Hohnke et al. | 404/98 |
| 3,382,815 | A | * | 5/1968 | Yoshiro et al. | 104/3 |
| 3,750,299 | A | * | 8/1973 | Plasser et al. | 33/287 |
| 3,863,329 | A | * | 2/1975 | Bartlett | 29/428 |
| 4,014,633 | A | * | 3/1977 | Goughnour | 425/63 |
| 4,616,395 | A | * | 10/1986 | Farese et al. | 29/460 |
| 4,632,308 | A | * | 12/1986 | Fischer | 238/265 |
| 4,641,779 | A | * | 2/1987 | O'Brien et al. | 238/7 |
| 5,331,745 | A | * | 7/1994 | Jager | 33/651.1 |
| 5,653,388 | A | * | 8/1997 | Pietschmann et al. | 238/7 |
| 6,109,825 | A | | 8/2000 | Yon | |
| 6,505,406 | B2 | * | 1/2003 | Robertson et al. | 33/1 G |
| 6,732,418 | B2 | * | 5/2004 | Rada | 29/428 |
| 6,808,660 | B2 | * | 10/2004 | Schwarzbich | 264/35 |

FOREIGN PATENT DOCUMENTS

| | | | | |
|---|---|---|---|---|
| DE | 24 22 942 | A | 11/1975 | |
| DE | 198 31 680 | A | 11/1999 | |
| DE | 100 48 842 | A | 10/2001 | |
| EP | 722012 | A1 * | 7/1996 | E01B/1/00 |
| EP | 803609 | A2 * | 10/1997 | E01B/3/28 |
| WO | WO 9851863 | A1 * | 11/1998 | E01B/21/00 |

OTHER PUBLICATIONS

English Translation of DE–10048842–A1; Feb. 2005.*

* cited by examiner

*Primary Examiner*—Michael P. Colaianni
*Assistant Examiner*—Michael I. Poe
(74) *Attorney, Agent, or Firm*—Sughrue Mion, PLLC

(57) ABSTRACT

A method of constructing a rail track in which a concrete track slab is produced and rail track anchor members are inserted in the track slab by an inserter system mobile along the route of the rail track includes the following steps: using a machine for continuously pouring concrete to produce two concrete walls laterally delimiting the edges of the track slab to be poured; pouring the concrete track slab between the walls; and using the inserter system to insert anchor members in the freshly poured track slab, the tie plate inserter system being adjusted accurately by a measuring station, topographical survey points, a measuring system, and reflectors carried by the inserter system.

9 Claims, 3 Drawing Sheets

METHOD OF CONSTRUCTING A RAIL TRACK IN WHICH A CONCRETE TRACK SLAB IS PRODUCED AND RAIL TRACK ANCHOR MEMBERS ARE INSERTED INTO THE TRACK SLAB

BACKGROUND OF THE INVENTION

1. Field of the Invention

The invention relates to a method of constructing a rail track in which a concrete track slab is formed and rail track anchor members are inserted into the slab by an inserter system which can move along the route of the rail track.

2. Description of the Prior Art

The document EP 0 803 609 describes a method and a device for inserting tie plates in concrete to produce a rail track quickly and cheaply. The inserter system includes a mobile platform straddling the freshly poured concrete slab so that the inserter system can be moved along the route of the rail track. Patent application FR 00 10120 describes accurately positioning this kind of tie plate inserter system by means of a measuring station referenced to topographic survey points at the edge of the route of the rail track, the measuring station including an optical measuring system cooperating with reflectors carried by the tie plate inserter machine to determine the location of the inserter system accurately.

However, this kind of track construction method has the drawback that its rate of advance is limited by the time needed to move the tie plate inserter system and to position it accurately.

Another drawback of this kind of construction method is that it requires the use of a relatively bulky tie plate inserter system, including a mobile platform which straddles the freshly poured concrete slab and whose width necessarily exceeds the width of the concrete slab to be constructed. The inserter system is also usually coupled to a machine for continuously pouring concrete which is placed in front of the tie plate inserter system and shapes the concrete slab by means of sliding shuttering. Using this kind of machine for continuously pouring concrete has the drawback of requiring concrete with a particular formula, whose texture is such that it cannot be pumped, which makes it necessary to transport a significant quantity of concrete by some other means, such as containers equipped with an agitator, before pouring the concrete by gravity.

It follows that this kind of construction method may prove impossible to use if space is limited on either side of the rail track, in particular when constructing rail tracks in tunnels or on bridges.

Thus, the object of the present invention is to remedy these drawbacks by proposing a method of constructing a rail track on a concrete slab using reduced quantities of continuously molded concrete, the remainder of the total volume of concrete required to construct the track slab consisting of concrete which can be pumped. Another object of the invention is to propose a construction method enabling the use of a machine for continuously pouring concrete and a compact system for inserting anchor members which is simple and economic to use.

SUMMARY OF THE INVENTION

To this end, the invention provides a method of constructing a rail track in which a concrete track slab is produced and rail track anchor members are inserted in the track slab by an inserter system mobile along the route of the rail track, which method includes the following steps:

a) using a machine for continuously pouring concrete to produce two concrete walls laterally delimiting the edges of the track slab to be poured;

b) pouring the concrete track slab between the walls; and c) using the inserter system to insert anchor members in the freshly poured track slab.

In particular embodiments the construction method according to the invention can have any of the following features alone or any technically feasible combination:

- the walls guide movement of the inserter system;
- the continuous pouring machine is guided during the step a) of producing the walls by a measuring station which is referenced to topographical survey points and includes an optical measuring system cooperating with reflectors carried by the continuous pouring machine;
- the inserter system has wheels, the distance between which is suitable for traveling on the walls, the wheels having an external flange engaging in front of the lateral edge of the wall and guiding the inserter system along the wall;
- the inserter system includes an articulated arm which inserts the anchor members accurately into the freshly poured concrete track slab, the articulated arm being positioned accurately by means of a measuring station which is referenced to topographical survey points and includes an optical measuring system cooperating with reflectors carried by the articulated arm of the inserter system;
- the track slab is made from concrete with a traditional formula that is fed between the two walls by means of a pump or truck mixer;
- the track slab is leveled by means of a vibrating float guided by the walls, the accuracy of the height of the vibrating float being tied to that of the walls;
- before the step b) of pouring concrete to produce the track slab, metal armatures are disposed between the two walls, in order to produce a reinforced concrete track slab;
- in the step a), a concrete foundation slab lying between the two walls is formed at the same time as the walls and the foundation slab has a thickness less than the height of the walls in order to leave between the walls a receiving cavity into which the concrete of the track slab is poured.

Objects, aspects and advantages of the present invention will be better understood from the description of one embodiment of the invention given hereinafter by way of non-limiting example and with reference to the accompanying drawings.

DETAILED DESCRIPTION OF THE PREFERRED EMBODIMENT

To clarify the drawings, only components necessary to understanding the invention have been shown.

Figure 1:
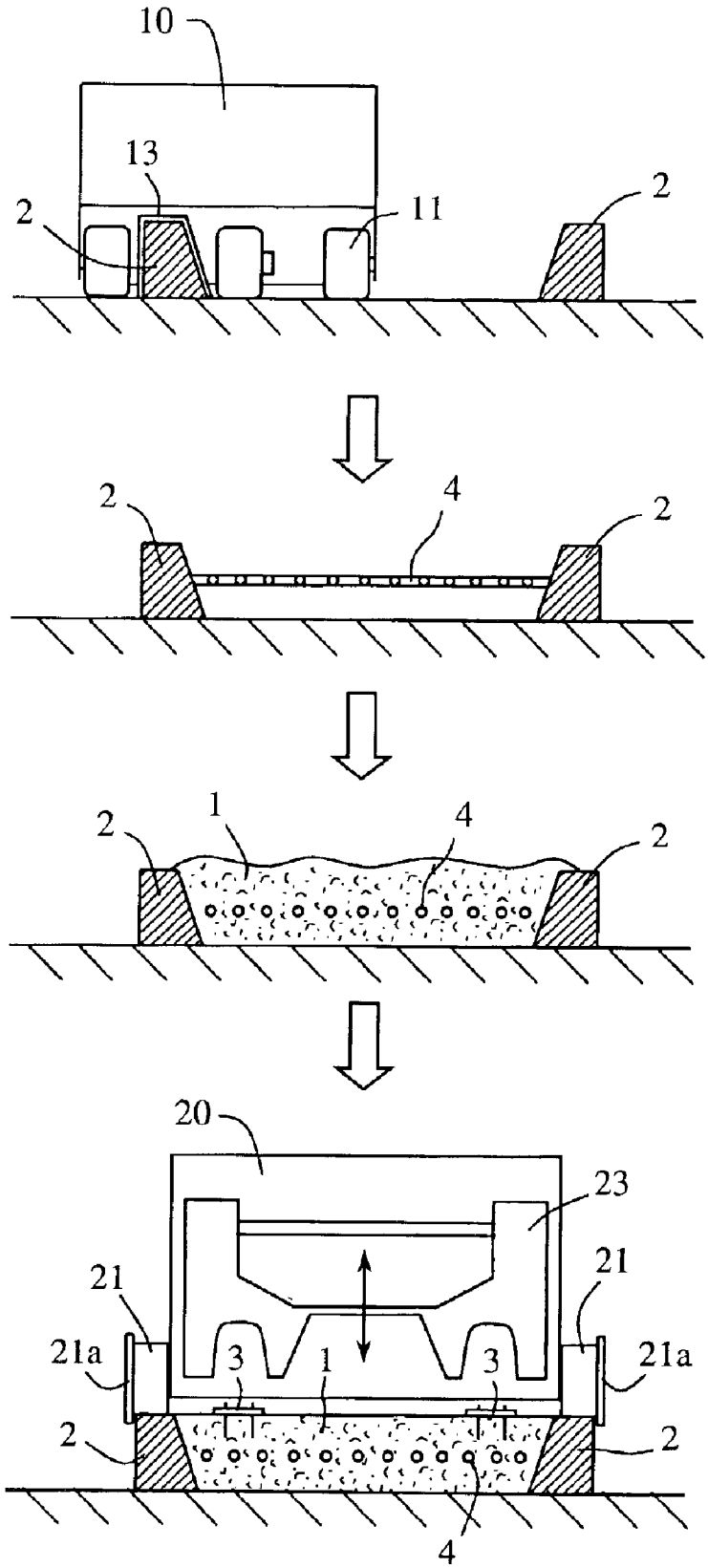
FIG. 1 is a diagrammatic representation of the steps of one particular embodiment of the method in accordance with the invention of constructing a rail track.

FIG. 1 is a diagram showing the steps of one particular embodiment of the method in accordance with the invention for constructing a rail track. In FIG. 1, in a first step of the method, two walls 2 with a height of the order of 20 to 40 cm and a width of the order of 10 cm are constructed along the route of the rail track, the two walls 2 delimiting laterally the edges of the concrete slab to be poured that will support the rail track. The walls 2 are preferably made of concrete using a compact machine 10 for continuously pouring concrete of the type described in the patent application FR-A1-2 662 452 and available from the company M-B-W. This kind of machine 10 is mounted on wheels 11 and includes a concrete hopper 12 for pouring concrete by gravity at the upstream end of sliding shuttering 13 for forming the wall 2.

Figure 2:
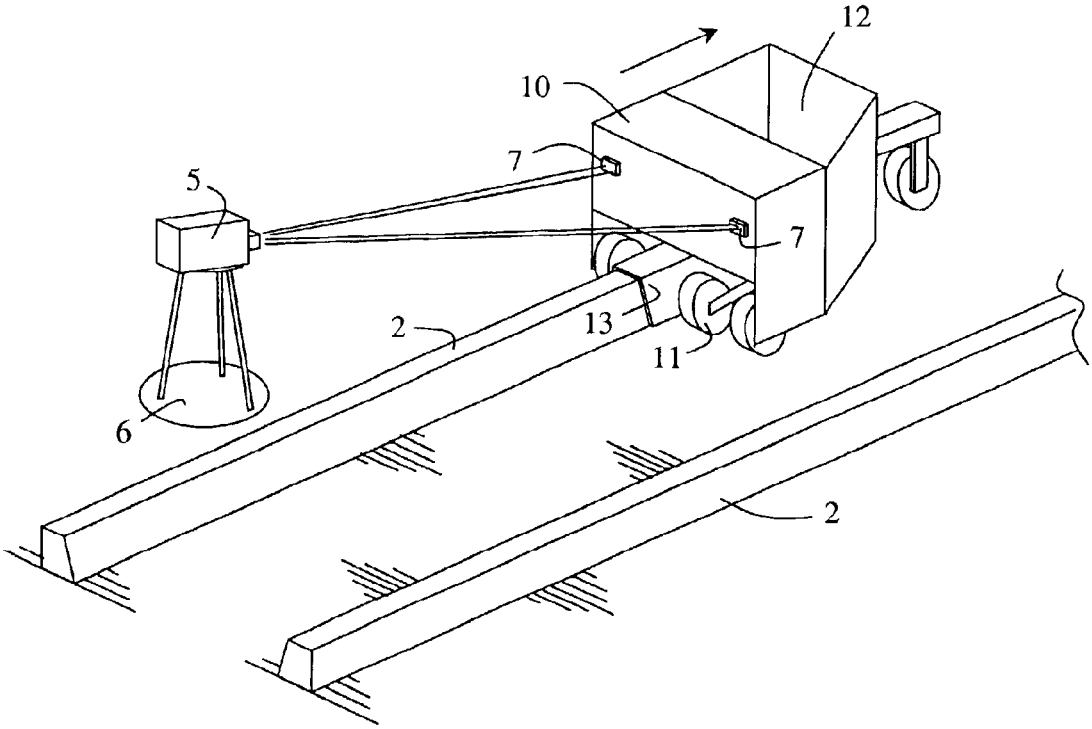
FIG. 2 is a diagrammatic perspective view of the step of the method shown in FIG. 1 for producing the walls.

During this step, as shown in more detail in FIG. 2, the continuous pouring machine 10 is advantageously guided as its moves forward by a measuring station 5 on a tripod and vertically above a topographic survey marker 6 at the edge of the route of the rail track. The measuring station 5 includes a distance measuring system equipped with send and receive optics for determining with very great accuracy the distance and the angle between the measuring station 5 and a set of reflectors 7 carried by the continuous pouring machine 10. The measuring system used is the LEICA TC/TCA 2003 laser system, for example.

During this first step, the height of the walls 2 is advantageously chosen so that the top surface of the walls 2 delimits the height of the concrete slab to be poured, the walls 2 having inside flanks that are inclined to the vertical so that the space between the two walls 2 forms a convergent cavity for receiving a concrete track slab 1.

In an optional second step of the method shown in FIG. 1, a metal armature 4 is placed between the two walls 2 in order to produce a reinforced concrete track slab 1. This step of the method can of course be dispensed with if a concrete track slab 1 with no armature 4 is required.

In a third step of the method, after the concrete constituting the two walls 2 has solidified, traditional concrete is poured into the cavity delimited by the two walls 2 to fill the cavity to a height at least equal to that of the top surface of the walls 2. The traditional concrete is pumped through a pipe connected to a hopper placed near the track, where there is sufficient room for it, for example. In one embodiment the hopper can also rest on wheels and travel along the two walls 2, in which case the concrete can be spread by means of a truck mixer.

Figure 3:
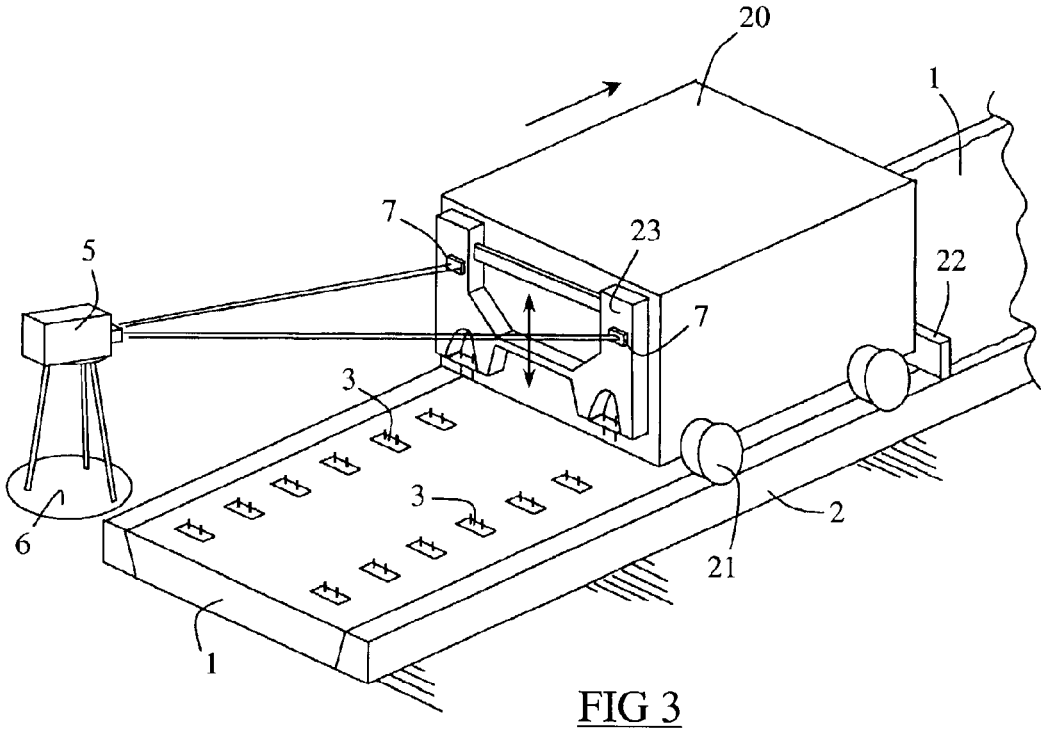
FIG. 3 is a diagrammatic perspective view of the step of the method shown in FIG. 1 for inserting the anchor members.

In a fourth step, shown in FIGS. 1 and 3, a compact tie plate inserter system 20 is moved over the freshly poured track slab 1, the inserter system 20 including a rectangular chassis resting on four wheels 21 with a distance between them suited to traveling along the walls 2. As shown in FIG. 1, each wheel 21 has an outside edge provided with a flange 21*a* engaging in front of the outside flank of the wall 2 and guiding the inserter system 20 along the wall 2.

In a manner that is known in the art, and as in the device disclosed in the document EP 0 803 609, the inserter system 20 also has an articulated arm 23 which moves vertically to insert tie plates 3 into the freshly poured concrete slab 1 and means for vibrating the concrete around the tie plate 3 during its insertion. The articulated arm 23 is disposed in the rear part of the chassis and includes reflectors 7 cooperating with a measuring station 5 to insert the tie plates 3 to an accuracy of better than one millimeter, as described in patent application FR 00 10120. The inserter system 20 further includes a vibrating float 22 at the front of the chassis which levels the surface of the track slab 1 to a height whose accuracy is tied to that of the top surface of the two walls 2.

Thus as the inserter system 20 moves forward, the freshly poured concrete slab 1 is leveled by the vibrating float 22 and the tie plates 3 are inserted successively by the articulated arm 23, the guiding of the wheels 21 along the walls 2 facilitating the positioning of the inserter system 20 as it moves forward.

Because it enables the use of a compact machine for continuously pouring concrete, this kind of method of constructing a rail track has the advantage that it can be used in places where the available space is limited. The machine for continuously pouring concrete is designed to produce low walls requiring little concrete, the track slab formed between the two walls being obtained by pouring traditional concrete, which has the advantage that it can be pumped, so that the hopper of concrete can be located some distance away, in a place where there is room for it.

What is more, in the method according to the invention, the walls are used to guide the tie plate inserter system along the rail track, which pre-positions the inserter system and reduces the time needed for accurately positioning the arms supporting the inserts.

The walls also have the advantage of serving as supports for any metal armatures to be inserted into the track slab, and also simplify installing trenches or drains in the track slab.

Figure 4:
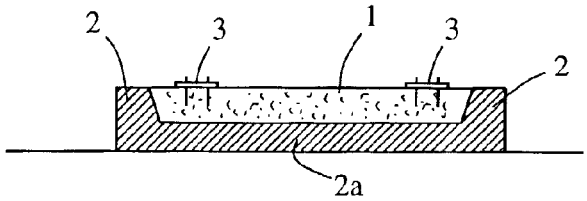
FIG. 4 is a sectional view of a rail track on a concrete slab obtained by a second embodiment of the construction method according to the invention.

FIG. 4 shows a variant of the method according to the invention in which the first step of the method is modified. The first step of the FIG. 4 method uses a machine for continuously pouring concrete, not shown in the figure, which includes sliding shuttering for simultaneously forming the two walls 2 and a foundation slab 2*a* at the base of the two walls 2. The resulting foundation slab 2*a* has a thickness which is very much less than the height of the two walls 2, of the order of 20 cm for a wall height of the order of 40 cm, so that a cavity remains between the two walls 2, into which the track slab 1 is poured. The subsequent steps of the method are identical to those described for the embodiment shown in FIGS. 1 to 3, the two walls 2 still providing a rolling surface for a tie plate inserter system 20 like that shown in FIG. 3.

This embodiment, although it necessitates the use of a larger machine for continuously pouring concrete, has the advantage of perfect relative positioning of the two walls, and enables the two walls to be produced faster, by reducing the time needed to position the continuous pouring machine. What is more, it retains the advantage of pre-positioning the inserter system through cooperation of the flanges of the wheels with the edges of the walls.

Of course, the invention is in no way limited to the embodiment described and shown, which has been described and shown merely by way of example, and can be modified without departing from the scope of the protection afforded to the invention, in particular with regard to the composition of the various components or by substituting technical equivalents.

There is claimed:

1. A method of constructing a rail track in which a concrete track slab is produced and rail track anchor members are inserted in said track slab by an inserter system mobile along the route of said rail track, which method includes the following steps:

a) using a machine for continuously pouring concrete to produce two concrete walls laterally delimiting the edges of said track slab to be poured;

b) pouring said concrete track slab between said walls; and c) using said inserter system to insert anchor members in the freshly poured track slab.

2. The method claimed in claim 1 of constructing a rail track, wherein said walls guide movement of the inserter system.

3. The method claimed in claim 1 of constructing a rail track, wherein said continuous pouring machine is guided during said step a) of producing said walls by a measuring station which is referenced to topographical survey points and includes an optical measuring system cooperating with reflectors carried by said continuous pouring machine.

4. The method claimed in claim 1 of constructing a rail track, wherein said inserter system has wheels, the distance between which is suitable for traveling on said walls, each of said wheels having an external flange engaging in front of the lateral edge of a corresponding one of said walls and guiding said inserter system along said walls.

5. The method claimed in claim 1 of constructing a rail track, wherein said inserter system includes an articulated arm which inserts said anchor members accurately, said articulated arm being positioned accurately by means of a measuring station which is referenced to topographical survey points and includes an optical measuring system cooperating with reflectors carried by said arm of said inserter system.

6. The method claimed in claim 1 of constructing a rail track, wherein, before said step b) of pouring concrete to produce said track slab, metal armatures are disposed between said two walls, in order to produce a reinforced concrete track slab.

7. The method claimed in claim 1 of constructing a rail track, wherein, in said step a), a concrete foundation slab lying between said two walls is formed at the same time as said walls and said foundation slab has a thickness less than the height of said walls in order to leave between said walls a receiving cavity into which the concrete of said track slab is poured.

8. The method claimed in claim 1 of constructing a rail track, wherein said track slab is made from concrete with a traditional formula that is fed between said two walls by means of a pump or truck mixer.

9. The method claimed in claim 8, of constructing a rail track, wherein said track slab is leveled by means of a vibrating float guided by said walls, the accuracy of the height of said vibrating float being tied to that of said walls.

* * * * *